United States Patent [19]

Jacobi, Jr.

[11] Patent Number: 4,773,167

[45] Date of Patent: Sep. 27, 1988

[54] HEATER

[75] Inventor: Cecil T. Jacobi, Jr., Marshall, Mo.

[73] Assignee: Amjo Infra Red Dryers, Inc., Mo.

[21] Appl. No.: 864,263

[22] Filed: May 19, 1986

[51] Int. Cl.[4] ..... F26B 3/28

[52] U.S. Cl. ..... 34/4; 34/41; 34/43

[58] Field of Search ..... 34/1, 4, 41, 43; 118/641, 642, 643; 101/416 A

[56] References Cited

U.S. PATENT DOCUMENTS

| | | | |
|---|---|---|---|
| 1,479,819 | 1/1924 | Kluever . | |
| 1,516,579 | 11/1924 | Dandforth . | |
| 2,236,754 | 4/1941 | Gurwick . | |
| 2,841,684 | 7/1958 | Miskella | 34/4 |
| 3,008,242 | 11/1961 | Sites et al. | 101/416 A |
| 3,657,825 | 4/1972 | Helm et al. . | |
| 3,829,982 | 8/1974 | Pray et al. . | |
| 3,935,647 | 2/1976 | Aschberger | 34/1 |
| 3,950,650 | 4/1976 | Pray et al. . | |
| 3,960,081 | 6/1976 | Gustaus et al. | 101/416 A |
| 3,994,073 | 11/1976 | Lackore . | |
| 4,143,278 | 3/1979 | Koch | 34/4 |
| 4,220,865 | 9/1980 | Silverman . | |
| 4,222,177 | 9/1980 | Mason . | |
| 4,297,583 | 10/1981 | Nerod . | |
| 4,312,137 | 1/1982 | Johne et al. | 101/416 A |
| 4,408,400 | 10/1983 | Colapinto . | |
| 4,449,453 | 5/1984 | Stoffer et al. . | |
| 4,526,101 | 7/1985 | Ericsson . | |
| 4,551,925 | 11/1985 | Ericsson | 34/4 |
| 4,619,050 | 10/1986 | Klemm | 34/4 |

*Primary Examiner*—Henry A. Bennet

*Attorney, Agent, or Firm*—Litman, McMahon & Brown

[57] ABSTRACT

A heater for drying printed material and the like is provided which includes a mounting frame for mounting the heater on a press and the like. The heater is movable on the mounting frame between operating and storage positions. A heat deflector assembly deflects heat away from the impression cylinder of the press. A heat lamp assembly is mounted on the heat deflector assembly and includes an enclosure with a pair of quartz tube, infrared heat lamps therein.

12 Claims, 3 Drawing Sheets

Fig. 1.
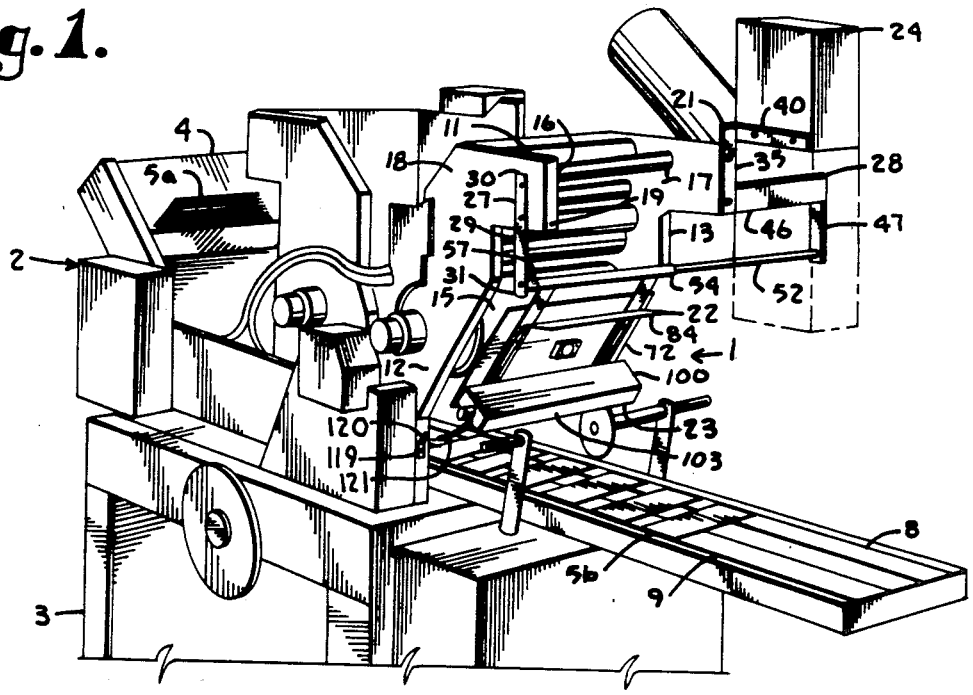
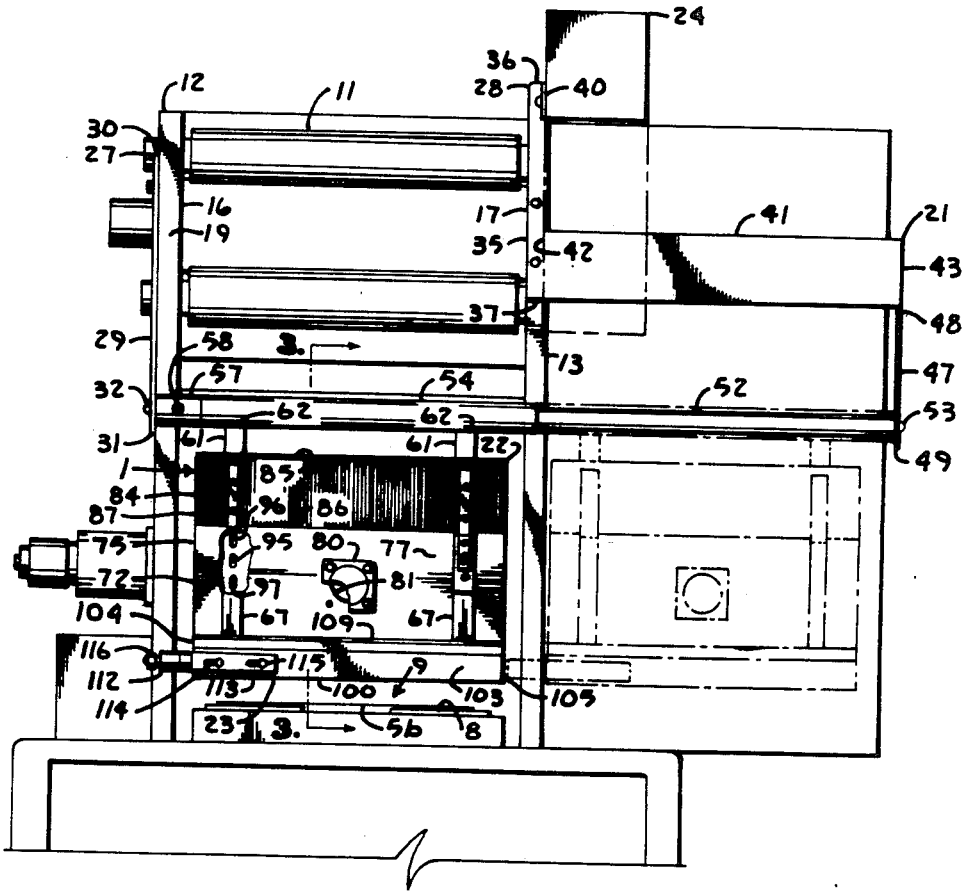
Fig. 2.

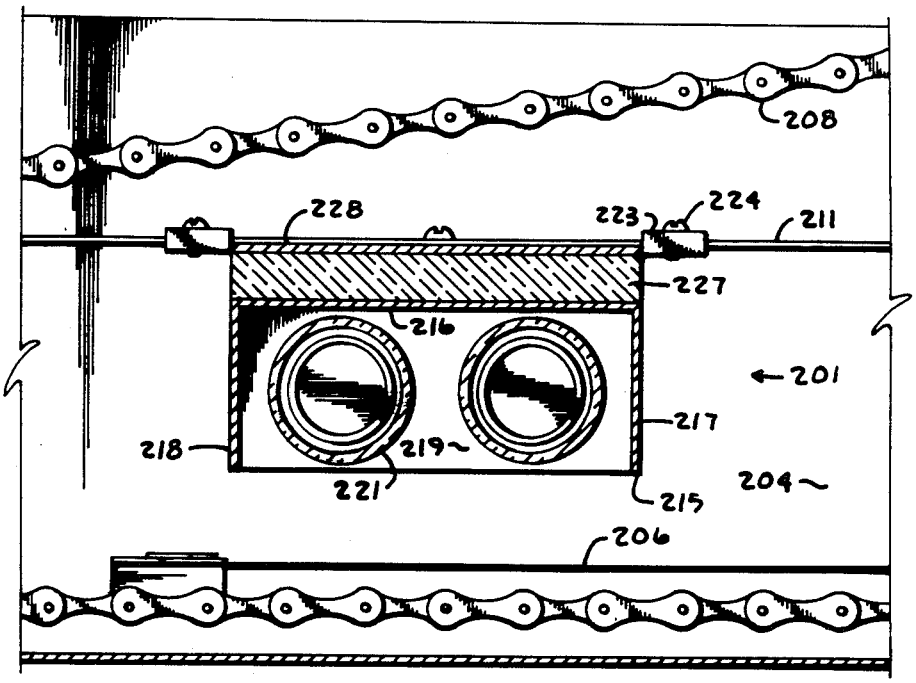
Fig. 6.
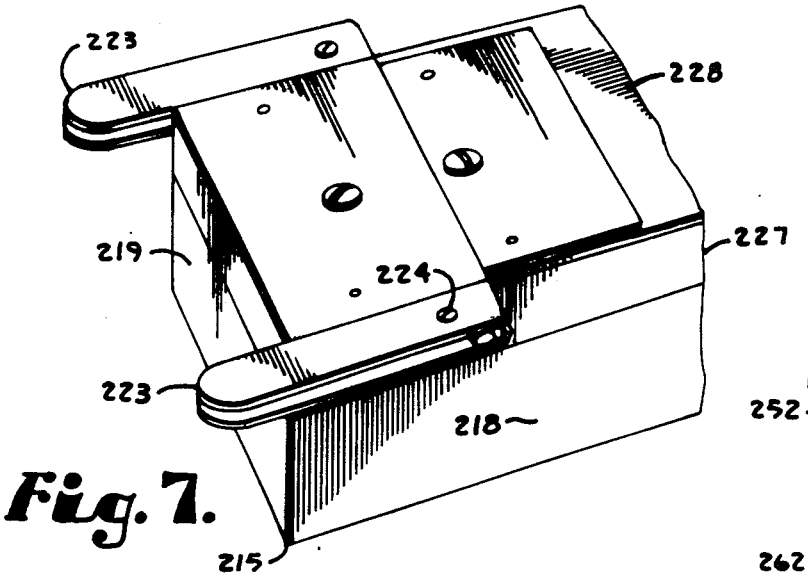
Fig. 7.
Fig. 8.
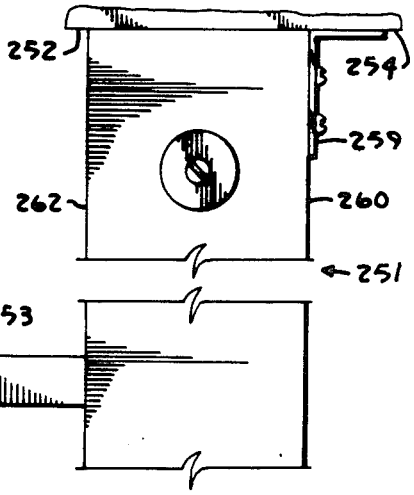
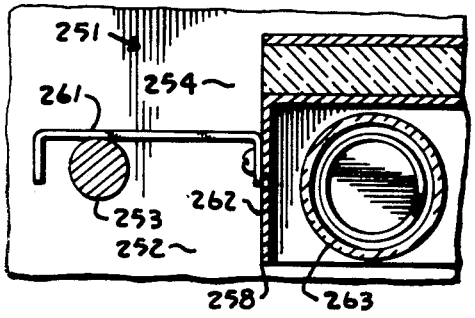
Fig. 9.

HEATER

BACKGROUND OF THE INVENTION

1. Field of the Invention

The present invention relates generally to heaters for printing presses and in particular to a heater with infrared quartz tube heat lamps for drying printed material in sheet-feed and envelope presses.

2. Description of the Prior Art

In certain types of printing operations, it is desirable to dry the printing ink more quickly than would occur if the printed material were merely exposed to the ambient atmosphere. Generally, higher quality printing work tends to require such supplemental drying. For example, color work with a glossy finish printed on a high quality of paper requires supplemental drying to avoid smearing the ink. Newspapers, on the other hand, are typically printed on webs of relatively low-quality paper which rapidly absorbs the ink and thus may not require supplemental drying.

Various methods have heretofore been employed for supplemental drying of printed materials. For example, the freshly-printed material can be sprinkled with anti-offset powder for absorbing the liquid solvents. Although this method consumes relatively little energy, the excess powder tends to disperse widely so that the press area may require frequent cleaning.

Convection heaters have also been used for drying printed materials and generally involve passing heated air over the printed material. However, convection drying is relatively inefficient and presents the problem of disposing of the solvent-laden exhaust air, which may contain unacceptable levels of environmental pollutants. Also, many convection heaters are too large or expensive for relatively small printing presses and installations where space is limited.

The aforementioned problems can be at least partly overcome by using radiant heaters or lamps for drying the printed materials. A relatively high percentage of the radiant energy generated thereby is transmitted through the atmosphere and absorbed by liquids and solids. Thus, for drying printed materials, radiant drying systems have been found to be more efficient than convection systems because with the latter much of the thermal energy is lost to the atmosphere, whereas with the former most of the radiant energy is absorbed by the printed material and the ink. Radiant energy can be directed to the printed material by reflectors to further increase efficiency.

Radiant energy in the short to medium wave length infrared range (i.e. about 0.75 to 1.50 and 1.50 to 3.00 microns respectively) is effective for drying printed material. Quartz tube heat lamps, for example, may be employed to produce such energy. They tend to be well suited for the requirements of the printing industry because they are relatively efficient and reasonable in cost.

Furthermore, quartz tube heat lamps tend to have relatively low thermal masses so that they heat up and cool down relatively quickly. This attribute is important for drying printed materials because in some heaters the heat lamps are operated only when the presses are actually running. A relatively low thermal mass allows a heat lamp to rapidly attain its operating temperature and correspondingly cool down quickly enough to avoid igniting the stationary printed material present in the drying area of the press when it stops.

Quartz tube heat lamps have yet another advantage in that their output can be relatively precisely controlled by varying the electrical current input thereto.

Quartz tube heat lamps have heretofore been used for drying printed materials. Prior art examples of such systems are found in the Hanson U.S. Pat. No. 2,065,070; the Early et al. U.S. Pat. No. 3,159,464 and the Visser U.S. Pat. No. 3,122,999.

Yet another example is shown in the Jacobi, Jr. et al. U.S. Pat. No. 4,501,072 which is assigned to a common assignee herewith. In the Jacobi, Jr. et al. '072 patent, heater panel assemblies with multiple quartz tube heat lamps are provided in a heater and are movable between open and closed positions. When a moving web of printed material is passing through the heater, the heater panel assemblies are relatively close thereto and the web is dried by radiant energy from the quartz tube heat lamps. If the web stops moving, e.g. when the press stops or the web breaks, the heater panel assemblies automatically retract to positions spaced from the web and the quartz tube heat lamps are extinguished.

Relatively small printing presses, e.g. for envelopes and sheets, often lack supplemental drying capabilities due to space limitations. Furthermore, even where sufficient space exists for the installation of a quartz tube heat lamp, the infrared radiation can interfere with the press operation by drying the ink on the impression cylinder unless means are provided for deflecting or exhausting such radiant heat away from the impression cylinder and, preferably, towards the printed material.

Heretofore there have not been available heaters for drying materials in printing presses and the like, especially relatively small sheet-feed and envelope presses, with the advantages and features of the present invention.

SUMMARY OF THE INVENTION

In the practice of the present invention, a heater is provided for drying printed material and the like which is adapted for mounting on a relatively small press for printing envelopes and sheets. The heater includes a mounting frame for attachment to the press with the heater movable between operative and stored positions. A heat deflector assembly is secured to the mounting frame and includes a main heat deflector panel with an exhaust fan mounted therein. An auxiliary heat deflector panel extends downstream from the main heat deflector panel. A heat lamp assembly is secured to the main heat deflector panel and includes a pair of quartz tube heat lamps. An electrical control system includes a variable power control and switch means for selectively energizing the heat lamps when the press is in operation.

Alternative embodiments of the invention are provided for stationary mounting within the delivery areas of presses whereby printed material passes thereunder and is dried by quartz tube heat lamps.

OBJECTS OF THE INVENTION

The principal objects of the present invention are: to provide a heater for drying printed material and the like; to provide such a heater which is particularly well adapted for use on relatively small printing presses; to provide such a heater which is particularly well adapted for use on envelope and sheet-feed presses; to provide such a heater which is movable between operating and storage positions; to provide such a heater which includes a heat deflector assembly for directing heat away from the impression cylinder of a printing press; to provide such a heater which utilizes quartz tube heat lamps; to provide such a heater wherein the lamps emit radiant energy in the short to medium wave length infrared ranges; to provide such a heater wherein the heat lamps are adapted to heat up and cool down relatively quickly; to provide such a heater with an electrical system adapted to automatically extinguish the heat lamps when the press stops; to provide such a heater which is adapted for placement within the delivery area of a press; and to provide such a heater which is simple to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective of a heater embodying the present invention, which is shown mounted on a sheet-feed press.

FIG. 2 is an elevation of the heater from a downstream end of the press.

FIG. 6 is a section of the first modified embodiment of the heater.

FIG. 7 is an enlarged, fragmentary perspective of the first modified embodiment of the heater.

FIG. 8 is a fragmentary plan of a heater comprising a second modified embodiment of the present invention with an alternative mounting bracket arrangement.

FIG. 9 is an enlarged, fragmentary, longitudinal section of the second modified embodiment of the heater.

DETAILED DESCRIPTION OF THE PREFERRED EMBODIMENTS

Figure 3:
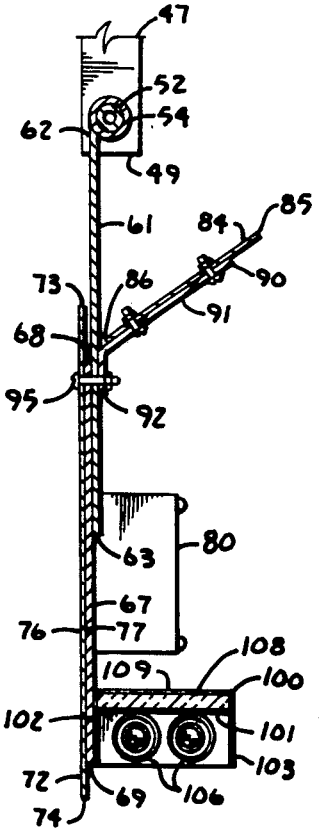
FIG. 3 is a longitudinal section of the heater taken generally along line 3—3 in FIG. 2.
Figure 4:
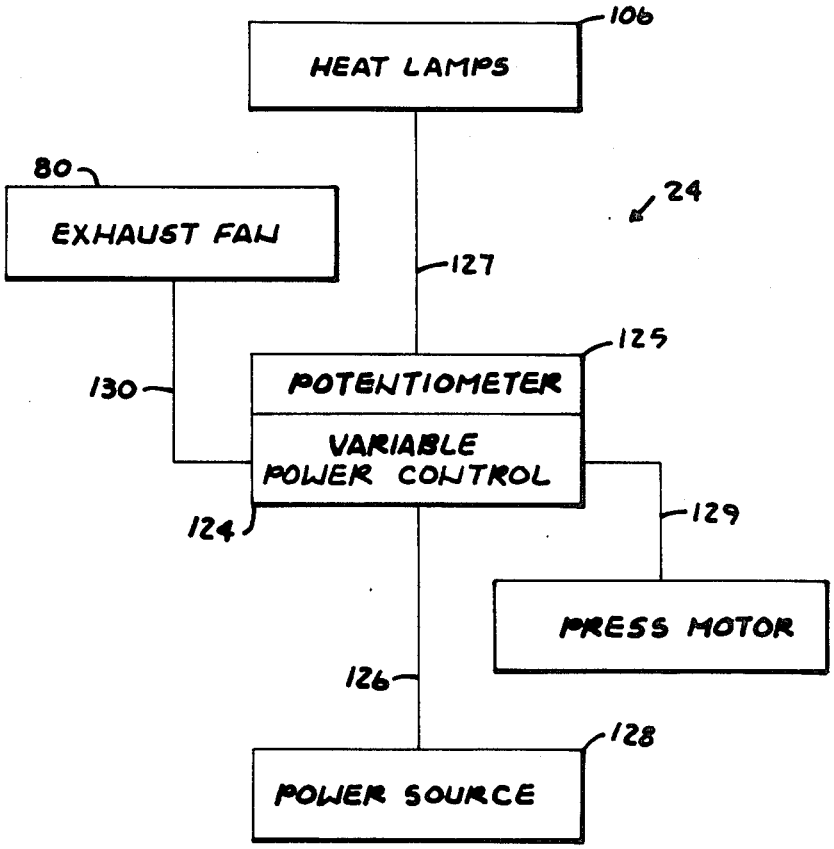
FIG. 4 is a schematic diagram of the heater showing its various components and their interrelationships.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The directional terms "upstream" and "downstream" are used in relation to the paths of movement of the workpieces, comprising printed materials, described in connection herewith. The terms "inner" and "outer" are used to describe transverse position and orientation with respect to the workpiece path.

As used herein, the term "heater" includes various types of devices for providing or converting thermal energy, including those that transfer heat by induction, convection and radiation. Without limitation on the generality of useful applications for the present invention, the embodiments disclosed herein are primarily for drying printed materials with radiant heat.

Referring to the drawings in more detail, the reference numeral 1 generally designates a heater for drying printed material and the like embodying the present invention and mounted on a printing press 2.

Without limitation on the generality of printing presses on which the heater 1 of the present invention can be installed, the printing press 2 comprises an envelope press with a base 3 and a hopper 4 for blank envelopes 5*a*. An output conveyor 8 extends from a delivery area 9 of the press 2 and printed envelopes 5*b* are accumulated thereon in overlapping, "shingled" configuration. The press 2 includes a downstream series of cylinders 11 journalled between first and second cylinder mounting arms 12, 13. The downstream series of cylinders 11 includes a large impression cylinder 15. The arms 12, 13 include respective first and second appendages 16, 17 which cantilever in a downstream direction above the output conveyor 8. Each appendage 16, 17 includes an outer face 18 and a downstream end 19.

The heater 1 generally comprises a mounting frame 21, a heat deflector assembly 22, a heat lamp assembly 23 and an electrical system 24.

The mounting frame 21 includes first and second mounting brackets 27, 28 for attachment to the first and second appendages 16, 17 respectively. The first mounting bracket 27 comprises a first clevis leg 29 with upper and lower ends 30, 31, the upper end 30 being secured to the first appendage outer face 18 by a suitable mechanical fastener 32, e.g. a machine screw, in spaced relation upstream from the first appendage downstream end 19. The clevis leg lower end 31 extends downwardly from the first appendage 17.

The second mounting bracket 28 includes a vertical standard 35 with upper and lower ends 36, 37. The standard 35 extends upwardly from the second appendage 17 and is secured to its downstream end 19 by fasteners 32. An upper, horizontal bar 40 extends from the vertical standard upper end 36 in a downstream direction.

A transverse extension leg 41 is coplanar with the vertical standard 35 and includes inner and outer ends 42, 43. The extension leg 41 is attached at its inner end 42 to the vertical standard lower end 37.

A connecting leg 46 of the second mounting bracket 28 is integrally connected to the extension leg outer end 43 and extends upstream therefrom, forming a right dihedral angle therewith. A second clevis leg 47 is integrally formed with the connecting leg 46 and includes an upper end 48 attached thereto and a lower end 49 depending downwardly therefrom.

A guide bar 51 extends transversely between the clevis leg lower ends 31, 49 and is attached thereto by mechanical fasteners comprising, for example, machine screws 53. The guide bar 51 is slidably received in a slide tube 54. A stop collar 57 is adjustably mounted on the guide bar 52 by a set screw 58 in proximity to the first clevis leg 29 whereby the range of travel of the slide tube 54 can be adjusted.

A pair of slide tube legs 61 having upper and lower ends 62, 63 are attached to respective ends of the slide tube 54 and depend downwardly therefrom. A plurality of vertically-aligned, threaded receivers 64 are located in each slide tube leg lower end 63.

The heat deflector assembly 22 includes a pair of heat deflector standards 67 having upper ends 68 secured to respective slide tube leg lower ends 63 and lower ends 69. A main heat deflector panel 72 includes upper, lower and side edges 73, 74, 75 and upstream and downstream faces 76, 77.

The heat deflector standards 67 are mounted on the downstream face 77 of the main heat deflector panel 72 by mechanical fasteners 95 which are received in slots 96 in the main heat deflector panel 72. The slots 96 are aligned in a pair of slot columns 97, with four slots 96 in each column 97 being located in the upper part of the heat deflector 72 and two slots 96 in each column 97 being located in the lower part thereof. The slots 96 permit the position of the main heat deflector panel 72 to be adjusted vertically.

The heat lamp assembly 23 comprises an open-bottom enclosure 100 with top, upstream and downstream panels 101, 102, 103 and opposite ends 104 and is attached to its upstream panel 102 to the heat deflector standard lower ends 69. A pair of quartz tube, infrared heat lamps 106 extend transversely between the enclosure ends 104. Each heat lamp 106 includes a nichrome element enclosed in a quartz tube.

The lamps 106 are preferably operated at temperatures in the range of 1200° F. to 1500° F. and emit infrared radiation with short and medium wave lengths in the respective ranges of 0.75 to 1.5 and 1.5 to 3.0 microns. Short and medium wave length infrared radiation has been found to be effective for drying printed materials. In particular, a rleatively large percentage of the infrared radiation is absorbed by the ink and printing solvents to be dried with relativley little energy loss to the atmosphere. Furthermore, the heat lamps 106 have relatively small thermal masses whereby they quickly heat up and cool down. The wave length of the radiation produced by the heat lamps 106 is inversely proportional to the electrical current input thereto, with greater input causing the heat lamps 106 to operate at higher temperatures and produce infrared radiation with shorter wave lengths.

A layer of ceramic fiber insulation 108 capable of withstanding temperatures of up to about 2600° F. is provided on top of the enclosure top panel 101 and a heat lamp assembly top reflector panel 109 is provided thereover whereby the insulation 108 is between the enclosure top panel 101 and the heat lamp assembly top reflector panel 109. A handle 112 includes a mounting section 113 secured to the enclosure downstream panel 103 by mechanical fasteners 115 received in slots 114. As shown in FIG. 2, the handle 112 extends transversely from the enclosure first end 104 and mounts a handle knob 116 which preferably comprises a material which is a relatively poor conductor of heat.

A suspension bracket 119 is mounted on the printing press first mounting arm 12 below the first appendage 16. The bracket 119 includes a hook 120. A tension member comprising a chain 121 is fixedly attached to the handle 112 at one end and releasably attached to the hook 120 at the other end. The longitudinal position of the heat lamp is adjustable by choosing the appropriate link of the chain 121 for attachment to the hook 120. An exhaust fan 80 is mounted on the main heat deflector panel 72 on its downstream face 77 and communicates with a central opening 81 therethrough.

An auxiliary heat deflector panel 84 includes upper, lower and side edges 85, 86, 87 and is attached to the slide tube leg lower ends 63 by auxiliary heat deflector panel mounting brackets 90. Each mounting bracket 90 includes an upper leg 91 attached to the auxiliary heat deflector panel 84 and a lower leg 92 attached to a respective slide tube leg lower end 63. The mounting bracket legs 91, 92 form an obtuse angle with respect to each other whereby the heat deflector panels 72, 84 form a corresponding obtuse dihedral angle with respect to each other. With the heater 1 mounted on the printing press 2, the auxiliary heat deflector panel 84 extends downstream from the main heat deflector panel 72.

The heat deflector panel 72, 84; the enclosure panels 101, 102, 103, 109; and the enclosure ends 104, 105 preferably all comprise a reflective material. For example, various types of polished or plated sheet metal may be employed. Thus, maximum radiant heat transfer to the printed envelopes **5*b*** is achieved.

The electrical system 24 includes a solid state power control 124 with silicon controlled rectifiers (not shown) and a control potentiometer and switch 125. The power control is mounted on the second mounting bracket upper bar 40. Other controls (not shown) for the press 2 may also be mounted on the second appendage 17, for example, below the power control 124. A power input line 126 connects the power control 124 to a suitable power source 128, for example, 110–120 volt A.C. 60 Hz. 20 amperes service. Naturally, for larger presses, the electrical power source 128 may provide 220 volts or more.

An output line 127 extends from the power control 124 to the heat lamps 106, which may be wired in either series or parallel. A remote switching line 129 connects the power control 124 to the electrical system of the press 2 so that the heat lamps 106 are automatically extinguished when the press 2 stops. For example, the power control 124 may be operably connected to the motor of the press 2. A fan lead 130 extends from the exhaust fan 80 to a suitable power source, for example, 110–120 volt 60 Hz. service. Preferably, the fan 80 and the heat lamps 106 are energized concurrently, although with separate power supplies since the power to the heat lamps 106 is variable and the power to the exhaust fan 80 is relatively constant.

In operation, the heater 1 is placed in an operating position by sliding the slide tube 54 along the guide bar 52 towards the first cylinder mounting arm 12 until the slide tube 54 engages the stop collar 57. The transverse position of the heater 1 can be adjusted by repositioning the stop collar 57 on the guide bar 52. The heater 1 is preferably positioned so that the heat lamps 106 are centered over the path of the printed envelopes **5*b* on the output conveyor 8. The heater 1 is then swung in an upstream direction and is secured by placing a link of the chain 121 over the hook 120**.

The longitudinal position of the heater 1 is controlled by choosing an appropriate link of the chain 121 for placement on the hook 120. Preferably, the heat lamps 106 project their infrared radiation in an upstream direction so that the printed envelopes **5*b* begin to dry as soon as they leave the impression cylinder 15. However, the heater 1 should be adjusted so that relatively little of its infrared radiation output impinges on the impression cylinder 15 so that the ink is not dried on the latter. The exhaust fan 80 draws hot air away from the impression cylinder 15 and thus tends to prevent the ink from being dried thereon by the heat generated by the heater 1. The heat deflector panels 72, 84, 109 are also configured to direct most of the heat output from the heat lamp 106 downwardly towards the printed envelopes 5b and away from the press downstream cylinders 11, including the impression cylinder 15. As shown in FIG. 1, when the press 2 is in operation, the main heat deflector panel 72 slopes in a downstream direction from bottom-to-top and the auxiliary heat deflector panel 84** is relatively horizontal.

The output of the heat lamps 106 is variable by means of the potentiometer 105 of the power control 124. With the press 2 in operation, the output of the heater 1 is preferably adjusted so that an optimum temperature of the printed envelopes 5b is achieved. For example, a temperature range of 100° F. to 110° F. has been found to be suitable for effectively drying many types of printed envelopes. Temperature probes for determining the temperature of the printed material are available for use with the heater 1 of the present invention.

The heat deflector assembly 22 cooperates with the heat lamp assembly 23 to optimize efficient drying with the dryer 1. Specifically, the infrared radiation from the heat lamps 106 is directed towards the printed envelopes 5b as they leave the impression cylinder 15. Thus, the envelopes 5b are substantially dry by the time they are shingled on the output conveyor 8, which prevents offset problems which might otherwise occur if the ink on the printed envelopes 5b were still wet. The heat deflector assembly 22, together with the enclosure insulation layer 108 and the reflector panel 109 divert the heat away from the impression cylinder the present invention achieves an optimum utilization of infrared energy directed at the printed envelopes 5b at precisely the stage of the printing process where the best results will be achieved, and avoids any interference with the printing process that might otherwise be caused by the infrared energy The heater 1 is placed in its inoperative position by unhooking the chain 121 from the hook 120 and sliding the heat deflector and heat lamp assemblies 22, 23 towards the second clevis leg 47, which projects outwardly from the printing press 2. The second clevis leg 47 limits the travel of the slide tube 54 along the guide bar 52. With the heater 1 in its inoperative position, the downstream cylinders 11, including the impression cylinder 15, are accessible.

The electrical system 24 is preferably arranged so that the heat lamps 106 are energized only when the press 2 is running. The heat lamps 106 may also be extinguished with the potentiometer switch 125. The power control 124 may comprise, for example, a Model 15 or a Model 36 series solid state power control available from Payne Engineering Co. of Scott Depot, W.Va.

Figure 5:
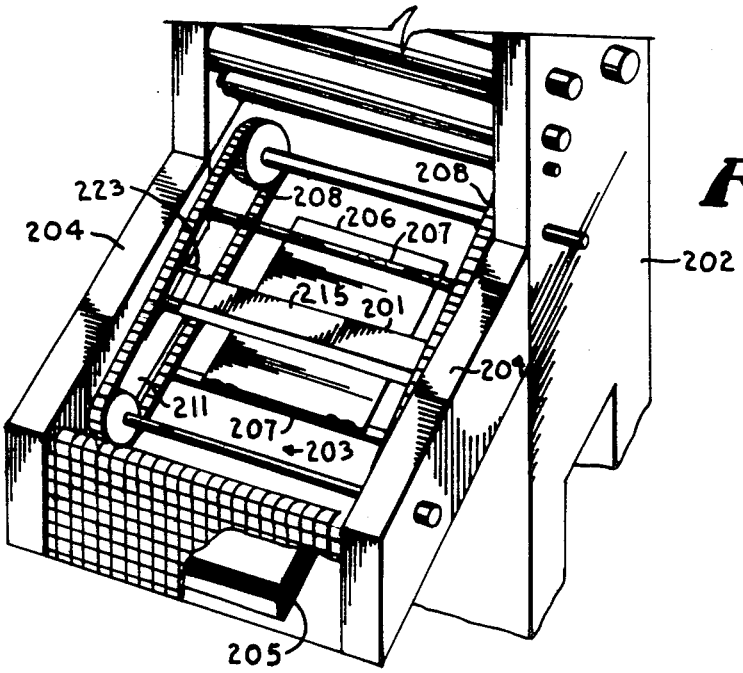
FIG. 5 is a perspective of a heater comprising a first modified embodiment of the present invention, which is shown mounted on an envelope press.

A heater 201 comprising a second modified embodiment of the present invention is shown in FIGS. 5, 6 and 7 and is mounted on a sheet-feed press 202. The press 202 may comprise, for example, any of Models 350, 360, 375, 380, 385 PRO and 9800 series available from the AB Dick Company of Chicago, Ill. The press 202 includes a delivery area 203 formed between a pair of delivery area side panels 204 and including an output hopper 205. Printed sheets 206 are pulled from the press 202 by a transverse draw bar 207 driven by chains 208 each positioned adjacent to a respective side panel 204. Projecting inwardly from the side panels 204 into the delivery area 203 are longitudinally extending press support ribs 211. Each press support rib 211 is positioned between the runs of a respective chain 208 and is substantially parallel thereto.

The heater 201 includes an enclosure 215 with top, upstream and downstream panels 216, 217, 218 and ends 219. A pair of transverse U-shaped clevis clips 223 are mounted on the enclosure 215 and project beyond the enclosure ends 219, for receiving the pres support ribs 211 whereby the enclosure 215 is mounted in the press delivery area 203. Each clevis 223 includes a set screw 224 for clamping to the press support ribs 211. An insulation panel 227 is mounted on the enclosure top panel 216 and a reflector panel 228 is mounted thereover.

The heater 201 includes an electrical system (not shown) which is substantially equivalent to the electrical system 24 of the heater 1 comprising the first embodiment of the present invention, except that the heater 201 does not have an exhaust fan. The enclosure 215 receives a pair of infrared, quartz tube heat lamps 221 which are substantially equivalent to the above-described heat lamps 106.

The reference numeral 251 generally describes a heater comprising a third modified embodiment of the present invention for mounting on a press 252 which includes a transverse bar 253 extending between side panels 254 of a delivery area 255. The heater 251 includes an enclosure 258 which is substantially identical to the enclosure 215 and receives a pair of infrared, quartz tube heat lamps 263. Angle brackets 259 are mounted on an upstream panel 260 of the enclosure 258 and are secured to the press side panels 254 by bolts. A support brace 261 is mounted on a downstream panel 262 of the enclosure 258 and extends in a downstream direction therefrom for resting on the transverse bar 253. An electrical system for the heater 251 is substantially identical to the electrical system for the heater 201.

In operation, the heaters 201, 251 radiate ultraviolet energy onto printed sheets which pass thereunder in respective delivery areas 203, 255. Like the heater 1, the heaters 201, 251 operate only when the respective presses 202, 252 operate. The respective designs of the enclosures 215, 258 optimize transmission of radiant energy to the printed sheets. Furthermore, their relatively compact size permits them to be placed within the respective press delivery areas 203, 255 without interfering with any of the moving parts of the presses 202, 252. The printed sheets pass entirely under the respective heat lamps 221, 263 in relatively close proximity thereto after ejection from the presses 202, 252 and before being stacked in the output hoppers thereof.

The heat lamp enclosures 215, 258 are designed for optimal placement in the path of the printed sheets whereat the latter are moving in relatively open air for a certain distance, which movement and air exposure tend to facilitate the drying process. Thus, the infrared drying effects of the heat lamps 221, 263 cooperate with such movement relative to the ambient atmosphere so that the printed sheets are quickly drawn out from under a layer of evaporated solvents, varnishes, pigments, etc. which is encountered directly under the heat lamps 221, 263. The heaters 201, 251 are easily removable from the respective presses 202, 252 for maintenance, replacement, etc.

It is to be understood that while certain forms of the present invention have been illustrated and described herein, it is not to be limited to the specific forms or arrangement of parts described and shown.

What is claimed and desired to be secured by Letters Patent is as follows:

1. In combination with a printing press having an impression cylinder and a path for workpieces comprising printed materials, the improvement of a heater for drying printed materials which comprises:

(a) mounting means adapted for movably mounting said heater whereby said heater is transversely movable between operative and storage positions;

(b) a heat lamp assembly connected to said mounting means and including:

(1) an enclosure with upstream, downstream and top panels comprising reflective material and opposite ends;

(2) a heat lamp extending between said enclosure opposite ends; and (c) a heat deflector assembly connected to said heat lamp assembly in a heat exchange relationship therewith, said heat deflector assembly being adapted to deflect heat from said heat lamp in a downstream direction away from said impression cylinder.

2. The heater according to claim 1, wherein said mounting means includes:

(a) a guide bar extending transversely; and (b) a slide tube slidably receiving said guide bar.

3. The heater according to claim 2, which includes:

(a) said mounting means having first and second clevis legs; and (b) said guide bar extending transversely between said clevis legs.

4. The heater according to claim 2, which includes:

(a) a pair of slide tube legs mounted on said slide tube and extending therefrom in parallel, spaced relation; and (b) said heat lamp assembly being connected to said slide tube legs.

5. The heater according to claim 1, which includes:

(a) said heat deflector assembly having a heat deflector panel mounted on said mounting frame and having upstream and downstream faces with respect to a workpiece path; and (b) said heat lamp assembly being mounted adjacent to said deflector panel downstream face.

6. The heater according to claim 5, which includes:

(a) said heat deflector panel having an exhaust fan opening therein; and (b) an exhaust fan mounted on said heat deflector panel downstream face in communication with said exhaust fan opening for drawing from said heat deflector panel upstream side and exhausting on said heat deflector panel downstream side.

7. The heater according to claim 5, which includes:

(a) said heat deflector panel comprising a main heat deflector panel; and (b) an auxiliary heat deflector panel connected to said main heat deflector panel and extending in a downstream direction therefrom.

8. The heater according to claim 1, which includes:

(a) said heat lamp assembly having a layer of insulation positioned over said top panel.

9. The heater according to claim 8, which includes:

(a) a reflective metal panel positioned over said insulation layer.

10. The heater according to claim 1 wherein said heat lamp comprises:

(a) a pair of quartz tube heat lamps, said heat lamps being adapted for emitting radiation in the infrared range.

11. The heater according to claim 1, which includes:

(a) an electrical system including a variable power source.

12. A heater, which comprises:

(a) a mounting frame including:

(1) first and second clevis legs positioned in transversely opposed relation;

(2) a transverse guide bar extending between said clevis legs;

(3) a stop collar slidably receiving said guide bar and positioned in proximity to said first clevis leg and having a set screw for securing said stop collar to said guide bar;

(4) a slide tube pivotably and slidably receiving said guide bar; and (5) a pair of slide tube legs mounted on said slide tube and extending therefrom in parallel, spaced relation;

(b) a heat deflector assembly including:

(1) a main heat deflector panel mounted on said slide tube legs and having upper and lower ends, upstream and downstream faces and a central opening;

(2) an exhaust fan mounted on said main heat deflector panel downstream face in communication with said central opening;

(3) an auxiliary heat deflector panel connected to said main heat deflector panel and extending in a downstream direction from said main heat deflector panel downstream face in proximity to the main heat deflector panel upper end, said auxiliary heat deflector panel forming a dihedral angle with said main heat deflector panel; and (c) a heat lamp assembly including;

(1) a heat lamp enclosure with upstream, downstream and top panels comprising reflective material and opposite ends;

(2) a layer of insulation placed over said enclosure top panel;

(3) a reflector panel placed over said insulation layer and comprising reflective material;

(4) a transverse quartz tube heat lamp positioned in said enclosure and extending between said opposite ends thereof; and (5) said enclosure being mounted on said main heat deflector panel downstream face in proximity to the lower end thereof.

* * * * *